US007717413B2

(12) United States Patent
Wiegmann et al.

(10) Patent No.: US 7,717,413 B2
(45) Date of Patent: May 18, 2010

(54) METHOD FOR QUALITY ASSURANCE IN THE OPERATION OF A PAPER-HANDLING UNIT

(75) Inventors: Michael Wiegmann, Koenigsbrunn (DE); Rodolf Eichler, Friedberg (DE); Uwe Meister, Elk Grove, CA (US)

(73) Assignee: Boewe Systec AG (DE)

( * ) Notice: Subject to any disclaimer, the term of this patent is extended or adjusted under 35 U.S.C. 154(b) by 211 days.

(21) Appl. No.: 11/703,938

(22) Filed: Feb. 8, 2007

(65) Prior Publication Data

US 2008/0133048 A1 Jun. 5, 2008

(30) Foreign Application Priority Data

Dec. 4, 2006 (DE) ..... 10 2006 057 061

(51) Int. Cl.
*B42B 2/00* (2006.01)
*B65H 5/30* (2006.01)
*B65H 43/00* (2006.01)
*B65H 39/00* (2006.01)

(52) U.S. Cl. ..... 270/52.02; 270/52.04; 270/52.05; 270/58.04; 700/223; 700/224; 700/220; 364/478.11

(58) Field of Classification Search ..... 370/52.02, 370/52.04, 59, 58.04, 52.05
See application file for complete search history.

(56) References Cited

U.S. PATENT DOCUMENTS 4,800,505 A * 1/1989 Axelrod et al. ..... 700/221
5,754,434 A * 5/1998 Delfer et al. ..... 700/223
6,711,462 B2 * 3/2004 Flores et al. ..... 700/223
7,075,667 B1 7/2006 Bonikowski et al.

FOREIGN PATENT DOCUMENTS

EP 0 465 166 A2 1/1992

OTHER PUBLICATIONS

English Translation of the International Search Report; PCT/EP2007/010430; Jun. 9, 2008; 2pgs.

* cited by examiner

*Primary Examiner*—Gene Crawford
*Assistant Examiner*—Yolanda Cumbess
(74) *Attorney, Agent, or Firm*—Beyer Law Group LLP

(57) ABSTRACT

A paper-handling unit serves for generating groups of items, wherein each group includes a plurality of items. The paper-handling unit includes at least one input channel for receiving the items, a portion to generate groups from the received items, a drive-out station for driving out a generated group, a detector detecting predetermined features from the items of a driven-out group, and a controller. The controller is operable to determine whether a predetermined event has occurred to drive the drive-out station to drive out a group if the predetermined event has occurred, to determine whether information was obtained from the detector during a predetermined interval, to stop the paper-handling unit if no information was obtained from the detector during the predetermined interval, and to stop the paper-handling unit if information was obtained from the detector during the predetermined interval which indicates that the driven-out group does not meet at least one predetermined criterion.

32 Claims, 3 Drawing Sheets

METHOD FOR QUALITY ASSURANCE IN THE OPERATION OF A PAPER-HANDLING UNIT

CROSS-REFERENCE TO RELATED APPLICATION

This application claims priority from German Patent Application No. 10 2006 057 061.8, which was filed on Dec. 4, 2006, and is incorporated herein by reference in its entirety.

BACKGROUND OF THE INVENTION

1. Field of the Invention

The present invention relates to a paper-handling unit and a method for controlling the same, and particularly to a novel development related to paper-handling units for improving and automating a quality assurance process for verifying the groups of items produced by the paper-handling unit.

2. Description of the Related Art

Prior art knows paper-handling units that receive individual items, for example personalized letters or sheets, assemble them to groups consisting of a plurality of individual items and process them for delivery. Such groups include, for example, a letter to a recipient and potentially one or more following pages (potentially also personalized) of the letter and objects (potentially also personalized) associated with the letter, for example credit cards or the like. Furthermore, the group may include enclosures (potentially also personalized). The assembled group is then prepared for delivery, for example by folding the group and sealing the edges of the folded group or by providing the accumulated group with an envelope. Furthermore, non-personalized enclosures, such as general information for the recipient of the letter, may be added to the group by the sender.

The control of such a unit is such that generally a so-called job description is provided by a central database, which indicates which individual sheets and/or individual objects provided to the unit are to be accumulated for their group. For example, when a personalized letter is received at the input channel of such a unit, a barcode printed thereon is detected to obtain the information required for the generation of the group from the job description.

The paper-handling unit then operates based on these control data to generate the desired group consisting of a plurality of individual items, which are then output at an output channel of the unit after the group has been completed. The output channel includes, for example, a shingle tray and/or further post-processing stations (e.g. franking units, sorting units, turning units, balances, etc.). The items generated there are then forwarded to the corresponding recipient, for example by postal delivery.

The above controller achieves high reliability when generating the individual groups and particularly with respect to each group containing the correct number of items and also the correct items.

However, errors in the unit may prevent individual following pages or enclosures for an item to be generated from being copied, for example due to copy errors, and thus from being added to the group. Thus, although the corresponding instructions were output to the handling unit by the controller, a situation occurs in which a group is indicated to be complete due to the information available to the controller, but the group is actually incomplete due to a mechanical error, for example when copying an enclosure. Such an incomplete group may nor readily be detected from a log that is generally also generated when processing a job, so that it is possible that the situation occurs that incomplete and thus faulty groups are generated and sent out. Such errors may be detected in units providing sensors for the detection of the copy at the corresponding stations. In the case of a malfunctioning of the sensors or in units without such sensors, it is, however, possible that the above situation will occur.

However, a particular problem are double or multiple copies, i.e. copying a different number of items than the desired number. In this situation, a higher number of following pages is copied when generating a group due to an error. This does not only result in an error in the group just generated, but also in the following groups. This is because the controller instructs the corresponding module of the paper-handling unit, when processing the next group, to copy another predetermined number of following pages of the corresponding enclosure. However, since at least one following page too many was copied when generating the previous group, the following group will contain at least one following page not belonging to this group (namely a following page actually associated with a subsequent group), even if the correct number of following pages is copied.

Thus, in the case of such an error, a situation may occur in which the whole job is faulty because incomplete and/or incorrect groups are generated which are then sent to the recipients.

Such a situation is disadvantageous not only in that the whole job has to be processed again, but also in that information may be sent to a recipient that was not intended for the same.

Yet another problem occurs when errors have occurred in the preparation of the enclosures or accompanying elements. Such elements are generated either immediately before they are supplied to the unit, for example by printers generating and outputting the personalized enclosures, or they are generated and provided in advance. In the course of this generation, errors may occur, so that a generated group no longer meets certain quality characteristics. For example, a generated page may be printed only partially or not at all, so that a group containing this page is regarded as incorrectly processed. It is also undesirable to send such a group to a recipient.

SUMMARY OF THE INVENTION

It is the object of the present invention to provide an improved method for controlling a paper-handling unit and a paper-handling unit in which the correct processing of groups generated by the unit is ensured.

The inventive approach for quality assurance is advantageous because stopping the paper-handling unit is not required for checking the groups, so that the throughput (groups generated/processed by the unit per time unit) is only slightly reduced in the case of correctly formed groups (due to the potentially required new generation of the driven-out group and/or due to the delay caused by the generation of a test group), which is, however, more than compensated for by the gained security At the same time, the inventive approach ensures that there is early intervention (stopping of the unit) in the case of an error, so that the generation of a high number of faulty groups is avoided.

In accordance with a first aspect, the present invention provides a method for controlling a paper-handling unit generating groups of items, wherein each group includes a plurality of items, the method having the steps of a) determining whether a predetermined event has occurred; b) if the predetermined event has occurred, driving a group out of the paper-handling unit; c) determining whether predetermined features were detected from the items of the driven-out group during a predetermined interval after driving out the group; d) if no features were detected during the predetermined interval, stopping the paper-handling unit; e) if features were detected during the predetermined interval, determining whether the driven-out group meets at least one predetermined criterion based on the detected features; and f) if the group does not meet the at least one predetermined criterion, stopping the paper-handling unit.

If the group meets the predetermined criterion, the paper-handling unit continues operating as before.

In accordance with a second aspect, the present invention provides a paper-handling unit for generating groups of items, wherein each group includes a plurality of items, having at least one input channel for receiving the items; a portion to generate groups from the received items; a drive-out station for driving out a generated group: a detector detecting predetermined features from the items of a driven-out group; and a controller operable to determine whether a predetermined event has occurred, drive the drive-out station to drive out a group if the predetermined event has occurred, determine whether information was obtained from the detector during a predetermined interval, stop the paper-handling unit if no information was obtained from the detector during the predetermined interval, and stop the paper-handling unit if information was obtained from the detector during the predetermined interval which indicates that the driven-out group does not meet at least one predetermined criterion.

Preferably, the predetermined interval is based on a predetermined time duration since driving out the group or on a predetermined number of groups generated since driving our the group. According to preferred embodiments, the predetermined event is the expiry of a predetermined time interval, the generation of a predetermined number of groups or an event specified in a job description, wherein the predetermined time interval and/or the predetermined number of items preferably depends on an error frequency in the operation of the paper-handling unit or is a function of the significance of the generated groups. The job description preferably includes information for the generation of each group, wherein the job description further specifies which ones of the generated groups are driven out or when a test group that is driven out is to be generated.

Preferred implementations of the present invention are defined in the sub-claims.

BRIEF DESCRIPTION OF THE DRAWINGS

Preferred embodiments of the present invention will be explained in more detail in the following based on the accompanying drawings, in which.

DESCRIPTION OF THE PREFERRED EMBODIMENTS

Figure 1A:
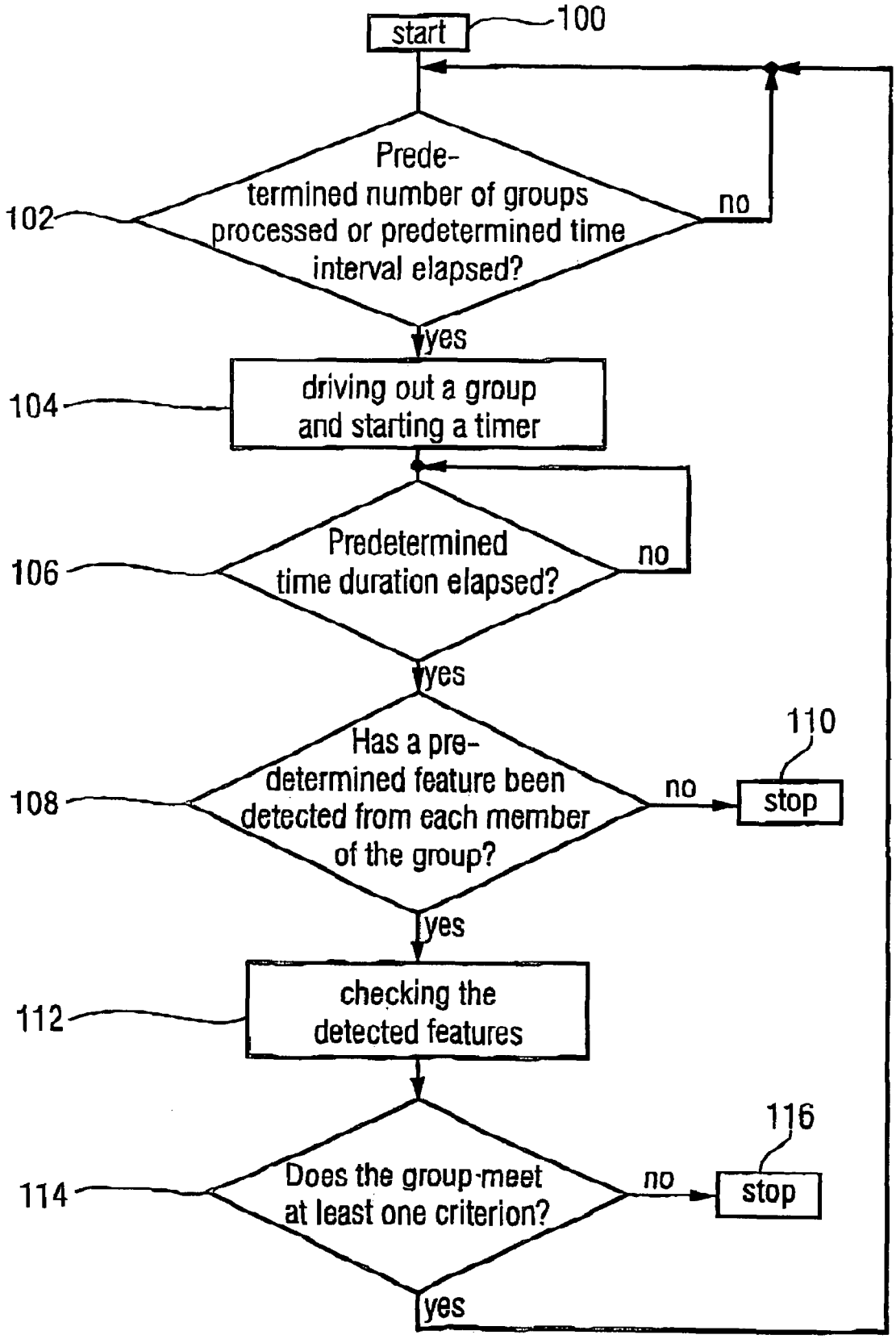
FIG. 1A shows a flowchart of an embodiment of the inventive method.

In the following description of the preferred embodiments, equal elements or elements acting in the same way are provided with the same reference numerals. It is further to be noted that, in the following description, the term "plurality" is used, which has the meaning of two or more.

FIG. 1A shows a flowchart of a preferred embodiment of the inventive method for controlling a paper-handling unit.

In a first step 100, the unit starts the processing, wherein step 100 includes all necessary steps to adjust the paper-handling unit for processing a predetermined job for generating groups of items. In particular, this also includes the provision of the required items at the input channels.

Once the paper-handling unit is completely adjusted, the processing of the desired job for generating the groups of items, for example letters to customers of a company, with which they receive a letter with following pages, objects and enclosures as well as general information, is started.

A next step 102 checks whether a predetermined event has occurred during the processing of the job, wherein this is preferably an expiry of a predetermined time interval or the generation of a predetermined number of groups. The predetermined number of processed groups and/or the predetermined duration of the desired time interval may be adjusted automatically via a controller or the paper-handling unit depending on various parameters. Alternatively, an operator of the paper-handling unit may also input after which time interval and/or after what number of processed groups there is to be a check, as will be discussed further below. For example, a reduction of the time duration and/or a reduction of the number of processed groups may be provided depending on the frequency with which errors occur during the processing of the job, so that the interval between checks becomes shorter. This may also be done dynamically by the controller by reducing the spacing of the events when an increased error frequency is detected, i.e. by reducing the number of generated groups and/or the duration of the time interval. If the error frequency is detected to decrease, the spacing between the events may be increased.

Alternatively or additionally, a spacing of the events may be adjusted depending on the significance of the job. For example, there may be jobs in which information is forwarded to the recipients of the respective letters that is intended only for these recipients and should not end up in the hands of other persons. This may, for example, be the case in the context of sending personal data, but also in the case of sending new credit cards or the like. In such a case, increased quality assurance is desirable, so that the spacing of the events in step 102 is decreased by reducing the time duration and/or by reducing the number of processed groups. If the job is a job of little importance, for example sending general information to a large circle of recipients, wherein the letter does not contain any significant personal data, the operator may adjust a larger spacing of the events via the controller of the paper-handling unit, for example by increasing the predetermined number of processed groups and/or the increase of the time interval.

As mentioned above, step 102 determines whether one of the events described above has occurred, and if this is not the case, the process continues to wait for this event, an expiry of a time interval and/or the generation of a predetermined number of groups.

If step 102 determines that the predetermined event in the form of a timeout and/or in the form of the generation of the predetermined number of groups has occurred, the method proceeds to step 104. In step 104, a group is driven out of the paper-handling unit, wherein the group will be checked with respect to its correct processing in the way described in more detail below. Step 104 initially only includes driving the group out of the processing process. In the described embodiment, it is a "normal" group that was actually intended for delivery to the recipient. As, in the preferred embodiment of the present invention, the group driven out in step 104 has, for example, already been inserted in an envelope for delivery and the inventive approach, as described below, potentially requires opening the envelope, this group has to be discarded after performing the inventive method, so that the group driven out in step 104 will be generated again by the unit after confirmation of its integrity according to the preferred embodiment of the present invention.

An alternative embodiment may provide that the unit controller is programmed such that a so-called test group is generated at predetermined events, wherein this group is not intended for delivery to a recipient. In such a case, not only the unit, but also the input channels and the like are designed for the generation of such a test group or "dummy" group. This "dummy" group is then driven out in step 104 for the inventive integrity check. This test group is generated in a similar way as a conventional group, so that completeness of this test group indicates a correct operation of the unit.

Figure 1B:
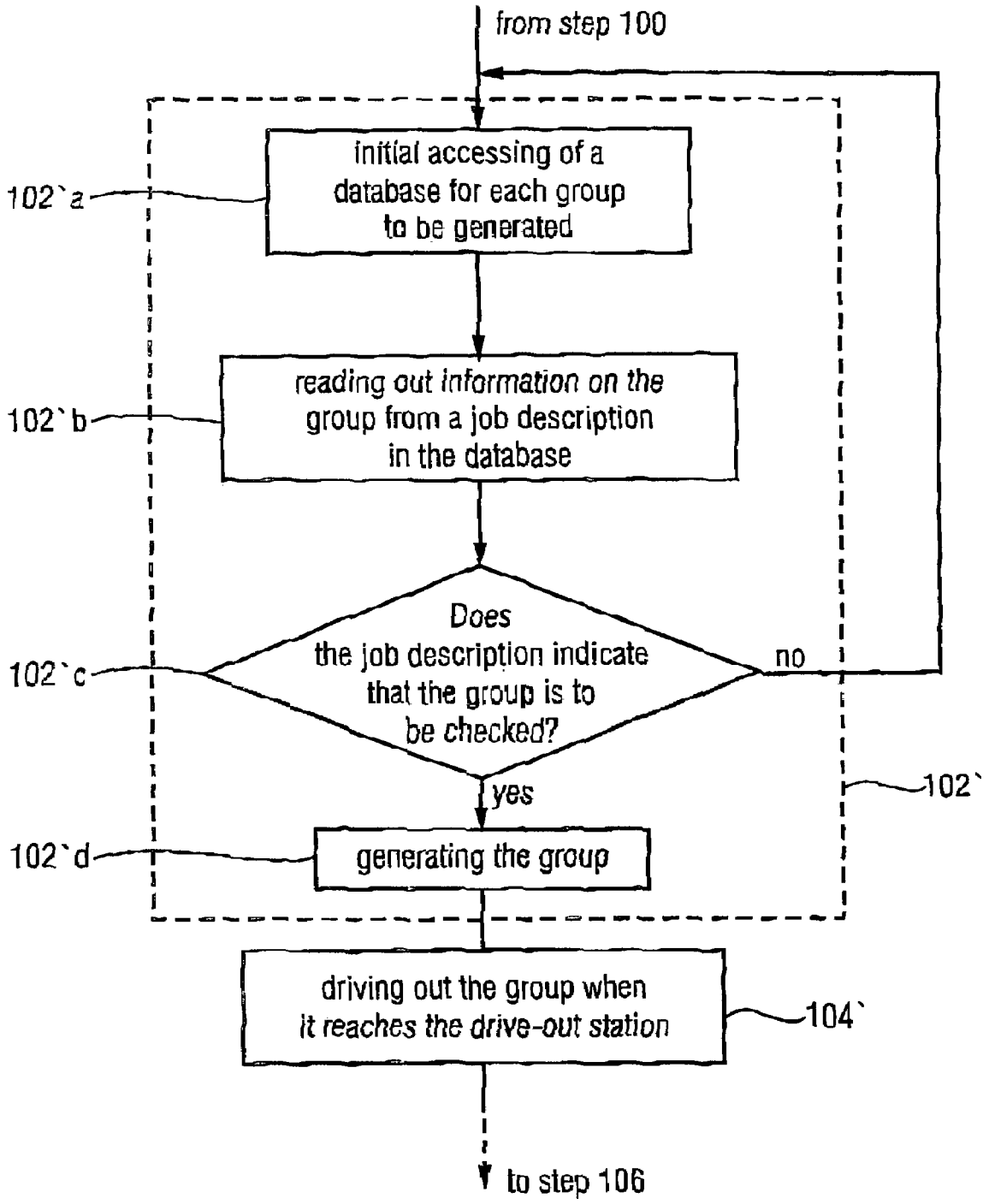
FIG. 1B shows a section of the flowchart of FIG. 1A according to a further embodiment of the inventive method.

In a further preferred embodiment described based on FIG. 1B, the event is specified via the job description. As mentioned above, the controller of a paper-handling unit operates such that the job description is provided by a central database and indicates which individual sheets and/or individual elements provided to the unit are to be accumulated for a group. FIG. 1B shows a step 102 modified as compared to FIG. 1A and a step 104 modified as compared to FIG. 1A. After the start of the unit in step 100 (see above), the steps 102' and 104' are executed according to this embodiment. Step 102' is divided into the sub-steps 102'*a* to 102'*d*. For each group to be generated, step 102'*a* initially includes accessing a database to read out the information required for the generation of the group in step 102'*b* and to provide it to the unit. This information further indicates whether the group to be generated is to be driven out later for checking, which is checked in step 102'*c*. If the group is not to be checked later on, the method returns to step 102'*a*. Otherwise, i.e. if the group is selected for checking, the group is generated by the unit according to step 102'*d* and driven out for checking when reaching a drive-out station in step 104'. Then the method continues at step 106 (see FIG. 1A).

The job description may freely define which of the groups are to be driven out. It may, for example, be provided for that initially groups are driven out more frequently, for example every $100^{th}$ group, which is useful because the unit has just been adjusted for the processing of the job and irregularities may occur more frequently than it is normal due to a potential re-adjustment of the unit with respect to a preceding job. After a number of processing runs, the unit may be assumed to run safely (e.g. the fine adjustments for this job are completed), and the spacing may be increased, for example, after reaching the $1000^{th}$ group formation, so that now only every $1000^{th}$ group is checked. The above is exemplary and, depending on the circumstances, the job description may freely specify which groups are to be driven out for checking.

Alternatively, instead of generating "real" groups, the job description may provide for the generation of test groups (dummy groups) not intended for delivery. The frequency of generating test groups is given in the job description (as above in the case of "real" groups).

Another example may provide that the leading document of a group, for example the letter to the recipient, which generally includes a barcode printed thereon to obtain the information required for the generation of the group from the job description, comprises an additional marking, for example as part of the barcode, indicating that the group with this letter is a "test group" to be driven out for checking. This additional marking may be detected, for example, already when the letter is initially read and may be passed on in the unit with the processing, so that the drive-out station effects the driving out of the group. Alternatively, it may also be provided for that this marking is read out by a sensor at or preceding the drive-out station.

After the group to be examined has been driven out of the paper-handling unit in step 104 and/or 104' and a timer has been started, step 106 checks whether a predetermined time duration measured by the timer has expired or not. Once this time duration has expired, step 108 determines whether a predetermined feature was detected during this time duration from each member of the driven-out group. It is to be noted that the detection of the features may begin as soon as immediately after the driving out and may also be completed prior to the expiry of the predetermined time duration.

In the described embodiment, the timeout of a timer is checked, but the invention is not limited to such an embodiment. Generally, a predetermined interval is monitored in step 106, which is based, for example, on a predetermined time duration since driving out the group or on a predetermined number of groups generated since driving out the group.

The predetermined feature preferably includes an identification attached to each item of the group and indicating an association of the item with the group. Detecting this predetermined feature includes either scanning part of the item using a hand-held scanner operated by an operator of the handling unit or automatic scanning of the driven-out group. Alternatively or additionally, there may also be scanned the whole item, for example the whole page, wherein in this case, instead of an identification, the necessary information on the association of the item with the group may be derived by the OCR recognition of the whole page. Furthermore, a physical property of the items and/or the group, for example the weight of the items and/or the group, a dimension of the items and/or the group (e.g. length, width and height—the latter, for example, for checking the folding quality) may be detected, transponders (e.g. RFID transponders) of the items may be read out and/or the items and/or the group may be scanned mechanically, for example to determine an overlap (shingle) of the items in the group.

If step 108 determines that no predetermined feature was detected, this indicates that the required checking of the driven-out group was not performed at the desired time. This may, for example, be due to the operator of the unit having neglected to scan the driven-out items of the individual group by means of the hand-held scanner during the predetermined time duration, or it may indicate an error in the automatic detection system. In such a case, the method proceeds to step 110, in which the paper-handling unit is stopped.

The unit is stopped in step 110 to prevent the further generation of groups of items without establishing the integrity of the groups, i.e. completeness of the groups, which are generated by the unit. In order to re-start the unit, it may, for example, be provided for that a corresponding control program is invoked by inputting a password, which again requests the detection of the identification features from the driven-out elements, and only afterwards, when the integrity, i.e. the completeness, of the group is confirmed thereby, is the unit re-started.

It is to be noted at this point that the paper-handling unit continues to operate during the time duration checked in step 106 to avoid unnecessary interruptions for the case that the subsequent integrity check has the result that the unit operates correctly.

However, if step 108 determines that features were detected from the items of the driven-out group during the time duration monitored in step 106, the method proceeds to step 112. In this step 112, the detected features are checked to determine, depending thereon, whether the driven-out group was complete or not. For this purpose, a database may be accessed, for example by means of the detected identifications. Preferably, the database is that in which the job description is also contained, i.e. the central database for the unit in which the necessary information on the composition of the group is contained, so that the detected identification markings allow determining whether the group is complete or not. However, the present invention is not limited to such an implementation. Instead of the central database, the information on the completeness of the group may also be deposited in a dedicated database, for example in a memory associated with the detector for detecting the features or being part of the detector. Alternatively, it may be provided for that the integrity check is done without accessing a database. In this case, the identification markings are chosen such that they do not only contain a group number, but also the associated group. Whereas, in the first example, it is sufficient to forward the group number to the database to verify the integrity of the associated group, in the second example the identification (for example a barcode) present/attached to the items will contain, for example, the group number and the serial number within the group.

Based on the detected features, step 114 checks whether the group is complete or not. If the group is complete, the method returns to step 102 and waits until the next event in which the next group is driven out and checked. If the group is incomplete and/or if the checking has the result that the detected features indicate an incomplete group, the paper-handling unit is stopped in step 116. In the described embodiment, the completeness of the group is checked, but the invention is not limited to such an embodiment. Generally, there is a check whether the group meets at least one predetermined criterion, such as the completeness of the group, the integrity of the group and/or the quality of the items in the group or the group.

The procedure described above does not only ensure that the group for an integrity check is really examined during the predetermined time duration, but also ensures that all elements and/or items of a group are examined. For the case that an operator or an automatic detection device check only part of the items of a group during the time duration monitored in step 106, i.e. detect the corresponding features of only part of the items, the unit is not stopped in step 110, but step 114 determines that the group seems to be incomplete at least based on the detected features, so that the unit is stopped in step 116 at the latest.

For such a case, it may be provided for that an operator has the possibility of invoking again a control program, for example via a password, which then requests the completion of the features to perform a final checking of the group for completeness. If all features of the items of the group have been checked and the group has been determined to be incomplete, the stopped paper-handling unit has to be reset to a defined starting state, including an elimination of the error. Furthermore, it is necessary to remove the items completed during the time duration monitored in step 106, which were output at the output, and also those items generated since the last integrity check for being on the safe side.

As already mentioned, the quality of the items of the driven-out group may be detected in step 112 and in step 114 according to a preferred embodiment, for example a print quality (e.g. color-fastness) of the letters, a folding position for folded elements or the like. If the quality is determined to be below a predetermined threshold, a stop of the unit may also be effected to eliminate the errors that led to the reduction in the quality. The quality of an item and/or a group may further be determined based on a barcode quality or a print position, and the quality of a group may be determined based on a positioning of the group in an envelope (e.g. arranged at the window position) and/or a positioning of the group with respect to a reference plane (e.g. a positioning such that the letter faces upwards).

In addition to the items of a group provided with identifications, general information, so-called enclosures, having no identification may also be sent to a recipient. Such enclosures may be provided with identifications, but this is not necessarily required. In this case, the number of these enclosures without any identification has to be detected, for example by complete scanning of such an enclosure when checking the integrity, to determine the completeness of the driven-out group.

Figure 2:
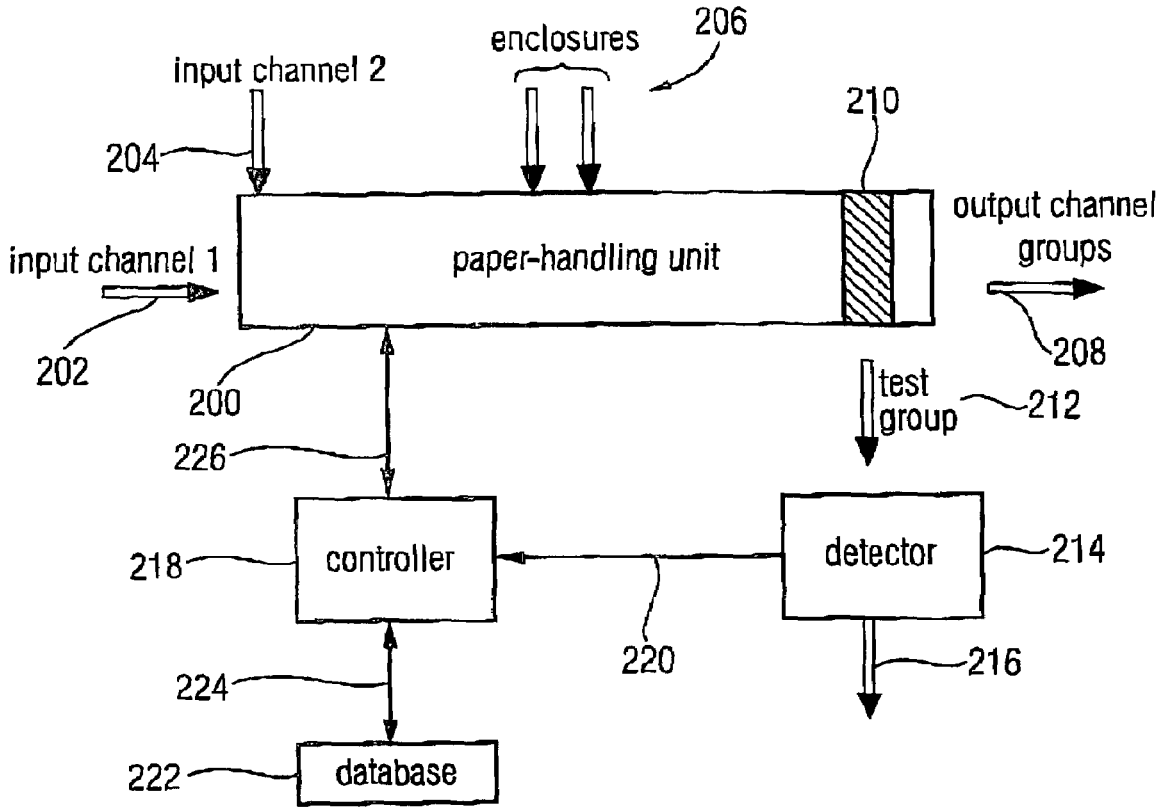
FIG. 2 shows a schematic illustration of the inventive paper-handling unit.

FIG. 2 shows a schematic illustration of the inventive handling unit operating in the inventive way described above. The paper-handling unit includes a section 200 including, for example, an assembly line, a folding station and/or an (envelope) inserter and the like, wherein the section 200 receives the items to be assembled from a first input channel 202 and a second input channel 204. Furthermore, the preferred embodiment or FIG. 2 provides a plurality of enclosure feeders 206 providing the above-mentioned enclosures. The portion 200 accumulates the correspondingly provided items to generate a group with a plurality of items output to an output channel 208. According to the invention, the paper-handling unit further includes a drive-out station 210, via which a test group 212 is driven out in the way described above when the predetermined event occurs and is provided to a detector 214 for detecting the features. After the detection of the features in the detector 214, the test group is removed from the processing process, as indicated by reference numeral 216.

The unit further includes a controller 218 receiving the features detected from the test group and/or from the individual items thereof via the data line 220. In the embodiment illustrated in FIG. 2, the controller 218 accesses a database 222 via the data line 224 to determine the integrity, i.e. the completeness of the examined test group 212, based on the information detected by the detector 214 via the database 222. Via a data line 226, the controller 218 is operatively connected to the unit to effect stopping of the handling unit in the case of incomplete groups or in the case that a driven-out test group was not examined.

The controller 218 further serves to provide the conventional control for the generation of the groups of items to the unit, as briefly discussed above in the introduction of the description.

Next, a particularly preferred embodiment for the inventive procedure for integrity checking of groups generated by a paper-handling unit is described based on FIGS. 1 and 2.

As already explained above, the basic idea is to select completed groups at predetermined or random times or event points and to verify them subsequently with respect to their completeness. In the embodiment described here, corresponding data sets are provided in the database 222 for each group to be generated, which contain not only general information, but also the individual components of the group. In normal operation, the controller 218 accesses the database 222 to correspondingly control the paper-handling unit to assemble the respectively desired group. In the database, it may be provided for, for example, already in advance that a group is to be examined which is then driven out at the drive-out station 210 and provided to the detector 214. According to a preferred embodiment, the group includes a plurality of individual sheets, which are scanned by an operator by means of a hand-held scanner or using a whole-page scanner.

When the paper-handling unit, for example an inserter, starts processing a job, a signal is output to the drive-out station 210 via the controller so that a predetermined group is driven out.

This may, for example, be a group already identified within the database, or this may occur after a predetermined number or after a predetermined time duration, as discussed above.

After removing and/or driving out the test group 212, the handling unit continues to operate normally with the processing of the current job. According to the invention, it is now necessary to check the generated group within a predetermined time frame, for example within 10 minutes, as to whether it was correctly processed. If such a validation process is not started, which may be noticed due to the lack of corresponding information from the detector 214 to the controller 218, the unit is stopped and the operator is notified that there is still a non-verified test group 212. The time frame of 10 minutes given above may be changed by the operator or in other ways described above. Furthermore, a maximally allowable time frame, for example 30 minutes, may be determined. This is necessary to ensure that an error in processing is detected as early as possible and not only after almost the whole job has been completed.

In the preferred embodiment, the validation of the test group 212 is done, as mentioned above, by scanning each individual page of the group, wherein each page is preferably provided with a unique code, so that the order of scanning is not important.

In addition, the quality of the various items may be checked, as discussed above, and an interruption of the process may also be performed when quality thresholds are not met.

If the checking has the result that the integrity of the group is okay, so that the group is complete, and/or that the quality is above the desired threshold, the current state is saved and processing continues.

Otherwise, i.e. if the group is not complete and/or if the quality is below a determined threshold, the unit, for example the inserter, is stopped immediately and an error message is displayed via a display of the controller. In addition, it may be provided for that the controller is disabled for the direct operator by a password. This ensures that only operating staff authorized to reset the job have access to the unit in such a case.

Furthermore, it may be provided for that the course of the processing of the job and particularly also the performed integrity checks are logged and that they are deposited in a corresponding file.

The inventive approach as described above has a significant advantage over conventional approaches, because there is now an additional safety feature reliably preventing the generation of incorrect or low-quality groups and their delivery to the recipient, because in the case that a test group is driven out but not checked, the unit is automatically stopped, i.e. verification is always forced. In this way, when there is an error in the integrity of a group, removing the pages of the groups generated since the last integrity test and the groups generated during the allowable time during which the validation has to be performed, allows ensuring that no potentially faulty groups are forwarded to a recipient.

In the above-described embodiment of the paper-handling unit, the drive-out station 210 is arranged in a predetermined position just in front of the output of the unit. Alternatively, the drive-out station may be arranged at any place in the input channel 202, 204, in the portion 200 or in the output channel 208, wherein there may also be provided a plurality of drive-out stations. This implementation allows monitoring the formation of groups or sub-groups in any positions of the paper-handling unit, also in various positions, for example at critical locations, where several items or item sub-groups are assembled (e.g. accumulation station) or processed (e.g. folding unit).

In the context of processing the items by the unit, an error may be detected already in advance at various places, for example in the input channel. Such items detected to be faulty and/or faulty groups are removed or marked as faulty prior to driving the group out of the paper-handling unit. If this group is intended to be checked, this situation would result in an error detection, because the examined group would be detected to be incomplete. As the group was detected to be faulty in advance, the result would be unnecessary stopping of the unit. In order to avoid this, the controller is notified that this group is skipped with respect to checking and checking is done, for example, only for the next group in the order or in the job description (modification of the event).

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A method for controlling a paper-handling unit generating groups of items, wherein each group includes a plurality of items, comprising:

(a) determining whether a predetermined event has occurred;

(b) if the predetermined event has occurred, removing a group from the paper-handling process, wherein the paper-handling unit continues to generate groups after step (a);

(c) determining whether predetermined features were detected from the items of the removed group during a predetermined interval after removing the group so that the start of a required validation process may be determined;

(d) if no features were detected during the predetermined interval which indicates that the required validation process of the removed group was not started, stopping the paper-handling unit;

(e) if features were detected during the predetermined interval which indicates that the required validation process of the removed group was started, determining whether the removed group meets at least one predetermined criterion based on the detected features; and (f) if the group does not meet the at least one predetermined criterion, stopping the paper-handling unit.

2. The method of claim 1, wherein the predetermined interval is based on a predetermined time duration since removing the group or on a predetermined number of groups generated since removing the group.

3. The method of claim 1, wherein the predetermined event is the expiry of a predetermined time interval, the generation of a predetermined number of groups or an event specified in a job description.

4. The method of claim 3, wherein the predetermined time interval or the predetermined number of items depends on an error frequency in the operation of the paper-handling unit or on the significance of the generated groups.

5. The method of claim 3, wherein the job description comprises information for the generation of each group, wherein the job description further specifies which of the generated groups are removed in step (b) or when a test group removed in step (b) is to be generated.

6. The method of claim 3, wherein a leading document of a group comprises a marking indicating that this group is to be removed for checking.

7. The method of claim 1, wherein the predetermined feature of an item includes an identification indicating the association of the item with a group.

8. The method of claim 1, wherein the removed group further includes an enclosure not including any identification, wherein the number of enclosures in a group is further detected to determine the completeness of the removed group.

9. The method of claim 1, wherein detecting a predetermined feature includes scanning part of the item or the whole item, detecting a physical property of the items or the group, reading out transponders of the items or mechanically scanning the items or the group.

10. The method of claim 1, wherein a database is accessed in step (e) to determine whether the removed group meets the at least one predetermined criterion.

11. The method of claim 1, wherein the at least one predetermined criterion includes the completeness of the group, the integrity of the group or the quality of the items in the group or the group.

12. The method of claim 11, wherein the quality of an item or a group is determined based on print quality, barcode quality, print position or fold position.

13. The method of claim 11, wherein the quality of a group is determined based on a positioning of the group in an envelope or a positioning of the group with respect to a reference plane.

14. The method of claim 1, wherein the removed group is generated again after step (g).

15. The method of claim 1, wherein faulty items or faulty groups are removed from the paper-handling unit or marked as faulty prior to removing the group, wherein in response thereto the predetermined event monitored in step (a) is modified.

16. A paper-handling unit for generating groups of items, wherein each group includes a plurality of items, said unit comprising:

at least one input channel for receiving the items;

a portion to generate groups from the received items;

a station for removing a generated group from the paper handling unit;

a detector for detecting predetermined features from the items of a removed group; and a controller, wherein said controller determines whether a predetermined event has occurred, drives the station to remove a group if the predetermined event has occurred, wherein said controller controls the paper-handling unit to continue to generate groups after the predetermined event has occurred, determines whether information was obtained from the detector during a predetermined interval so that the start of a required validation process may be determined, stops the paper-handling unit if no information was obtained from the detector during the predetermined interval which indicates that the required validation process of the removed group was not started, and stops the paper-handling unit if information was obtained from the detector during the predetermined interval which indicates that the required validation process of the removed group was started and that the removed group does not meet at least one predetermined criterion.

17. The paper-handling unit of claim 16, wherein the predetermined interval is based on a predetermined time duration since removing the group or on a predetermined number of groups generated since removing the group.

18. The paper-handling unit of claim 16, wherein the predetermined event is the expiry of a predetermined time interval, the generation of a predetermined number of groups or an event specified in a job description.

19. The paper-handling unit of claim 18, wherein the time interval or the number is adjustable via the controller depending on an error frequency in the operation of the paper-handling unit or as a function of the significance of the generated groups.

20. The paper-handling unit of claim 18, wherein the job description comprises information for the generation of each group, wherein the job description further specifies which of the generated groups are removed or when a test group that is removed is to be generated.

21. The paper-handling unit of claim 18, wherein a leading document of a group comprises a marking indicating that this group is to be removed for checking, wherein a sensor at or preceding the station reads out the marking.

22. The paper-handling unit of claim 16, wherein the predetermined feature of an item includes an identification indicating the association of the item with the group.

23. The paper-handling unit of claim 16, wherein the detector scans each item of the removed group as a whole or in part, detects a physical property of the items or the group, reads out transponders of the items or mechanically scans the items or the group.

24. The paper-handling unit of claim 16, comprising a database which the controller accesses to determine whether the removed group meets the at least one criterion.

25. The paper-handling unit of claim 16, wherein the at least one predetermined criterion includes the completeness of the group, the integrity of the group or the quality of the items in the group or the group.

26. The paper-handling unit of claim 16, wherein the detector determines the quality of an item or a group based on print quality, barcode quality, print position or fold position.

27. The paper-handling unit of claim 16, wherein the detector determines the quality of a group based on a positioning of the group in an envelope or a positioning of the group with respect to a reference plane.

28. The paper-handling unit of claim 16, wherein the controller causes the removed group to be generated again.

29. The paper-handling unit of claim 16, wherein the input channel includes a roller applier with cutter, a sheet applier or an accumulation station, the portion for generating the groups includes an assembly line, a folding unit or an inserter, and an output channel is provided, including an output belt.

30. The paper-handling unit of claim 16, wherein the portion for generating the groups includes at least one enclosure feeder for providing enclosures without identification, wherein the detector further detects the number of enclosures in the removed group.

31. The paper-handling unit of claim 16, wherein the station is arranged at a predetermined position in the input channel, in the portion or in the output channel.

32. The paper-handling unit of claim 16, comprising a plurality of stations, so that the group formation may be monitored at several positions of the paper-handling unit.

* * * * *